US008354964B2

(12) United States Patent
Johnson

(10) Patent No.: US 8,354,964 B2
(45) Date of Patent: Jan. 15, 2013

(54) ANTENNA SYSTEM HAVING COMPACT PIFA RESONATOR WITH OPEN SECTIONS

(76) Inventor: Greg F. Johnson, Aptos, CA (US)

( * ) Notice: Subject to any disclaimer, the term of this patent is extended or adjusted under 35 U.S.C. 154(b) by 399 days.

(21) Appl. No.: 12/576,908

(22) Filed: Oct. 9, 2009

(65) Prior Publication Data

US 2010/0271279 A1 Oct. 28, 2010

Related U.S. Application Data

(60) Provisional application No. 61/104,255, filed on Oct. 9, 2008.

(51) Int. Cl.
*H01Q 1/38* (2006.01)

(52) U.S. Cl. ..... 343/700 MS; 343/702; 343/845; 343/846

(58) Field of Classification Search ..... 343/845, 343/846, 700 MS, 702
See application file for complete search history.

(56) References Cited

U.S. PATENT DOCUMENTS

| | | | | |
|---|---|---|---|---|
| 6,980,154 | B2 * | 12/2005 | Vance et al. | 343/700 MS |
| 7,362,271 | B2 * | 4/2008 | Iwai et al. | 343/700 MS |
| 2002/0070902 | A1 | 6/2002 | Johnson et al. | |
| 2002/0089459 | A1 | 7/2002 | Johnson | |
| 2002/0158803 | A1 | 10/2002 | Hill et al. | |
| 2005/0259013 | A1 * | 11/2005 | Gala Gala et al. | 343/702 |
| 2006/0033667 | A1 | 2/2006 | Johnson | |

OTHER PUBLICATIONS

"PCT International Search Report and Written Opinion Dec. 2, 2009".

* cited by examiner

*Primary Examiner* — Dieu H Duong
(74) *Attorney, Agent, or Firm* — Briggs and Morgan, P.A.

(57) ABSTRACT

A low-height PIFA-fed antenna system having high gain, wide bandwidth and wide beamwidth for applications on wireless communications devices. The antenna is suitable for internal installation within a handset, such as a cellphone. The antenna includes a ground plane conductor, such as the ground plane of a wireless device, and a resonator element having a top portion with a split free end defining an open space. The antenna is well adapted for high volume manufacturing processes using conventional fabrication techniques such as metal stamping or selectively plated plastic.

19 Claims, 5 Drawing Sheets

ANTENNA SYSTEM HAVING COMPACT PIFA RESONATOR WITH OPEN SECTIONS

RELATED APPLICATIONS

This application claims the benefit of provisional application Ser. No. 61/104,255, filed Oct. 9, 2008, and incorporated by reference herein.

BACKGROUND OF THE INVENTION

The present invention relates to antenna assemblies for hand-held radio frequency transmitters and more particularly to antenna assemblies for communications devices such as cellular telephones.

BACKGROUND OF THE INVENTION

Handsets used in the cellular communications industry benefit from optimum performance from antenna systems in order to maximize the two-way voice or data link between a remote base station and the handset. Most current cellphone antennas utilize either dipole, or half-dipole antennas, mounted external or internal to the handset, all of which may be susceptible to RF radio frequency loss to the hand and other inefficiencies related to their size and location on the handset.

Known wireless communications devices (WCD) utilize internally-mounted planar inverted "F" antennas (PIFA). Prior art PIFA's provide limited electrical performance over the current wide frequency ranges used in WCDs such as cellphones. One such band is the 1710-2170 MH range, which includes the 1800-1900 MHz and UMTS bands (world cellular and 3G bands). Prior art PIFA's have narrow bandwidth, omni- or near omni-radiation pattern, and relatively low efficiency. The omni-radiation pattern derives from the fact that the installation location of the PIFA resonator causes the ground traces of the printed circuit board (PCB) to be the primary radiating element of the antenna. Power loss to the hand and head of the handset user dramatically reduces antenna efficiency.

In a typical application, the link budget between a base station and a handset of the prior art is degraded by 6 dB within the high frequency range due to increased path loss, as compared to the 800-900 MHz bands. Cellphones typically operate at the same maximum power level in all frequency bands, low and high, and therefore an antenna system capable of recouping even a portion of the 6 dB loss would be highly desirable. Additionally, an antenna system that reduces power losses to the head and hand of the user is also highly desirable given the reduction of SAR.

FIGS. 15-17 depict top, end and side views of a prior art PIFA resonator 150 having top leg 152, side leg 153, an RF feed point leg 154, and a height dimension 155. FIGS. 18-19 depict top and side views of the PIFA resonator 150 as connected to a ground plane conductor 157 of a wireless communications device. Ground plane conductor 157 may be formed by the ground traces of a PCB of the WCD, such as a cellular handset. The resonator 150 is grounded to ground plane conductor 157 at location 158 which is at or very near the longitudinal edge 159 of the ground plane conductor 157. Additional aspects of PIFA antenna systems and wireless communications devices may be found in U.S. Pat. No. 7,230,574, entitled Oriented PIFA-type device and method of use for reducing RF interference, incorporated by reference herein.

SUMMARY OF THE INVENTION

An antenna system of the present invention utilizes a uniquely oriented PIFA-fed conductor which minimizes hand loss, provides a wide voltage standing wave ratio (VSWR) bandwidth, high gain, and with resulting higher efficiency than current antenna systems used on handsets.

An antenna system of the present invention includes a ground plane conductor and a PIFA resonator with a top portion having an open section proximate to its free end. The open section may be defined between bridge conductor section(s) or apertures in the top portion of the resonator. In one embodiment, the top portion includes a bifurcated free end defined between a pair of generally parallel legs. The open section of the top portion permits a substantial reduction in the height of the top leg relative to a ground plane conductor of a wireless communications device. As a result, embodiments of the present invention are substantially more compact in size relative to prior art PIFA antenna systems.

An 1800-1900/UMTS band antenna system in accordance with one embodiment of the present invention is capable of improved efficiency as compared to prior art antennas, particularly in the range of 3 to 10 dB. Embodiments of the present invention present a substantial improvement over the prior art with respect to PIFA top leg height above the ground plane vs. antenna gain, bandwidth, and beamwidth in the hemisphere away from the user's head and body. The oriented PIFA design of the present invention also greatly reduces power loss to the user's hand. The power that is typically lost to the user's head in prior art antennas is added to that radiated out into the hemisphere away from the head by the antenna embodiments of the present invention.

A device according to the present invention includes a WCD implemented for operation over single or multiple frequency-bands. An antenna may be incorporated within a WCD at the time of manufacture, or may be provided as an accessory or aftermarket item to be added to existing WCDs having an external antenna port. The antenna of the present invention is suitable for high-volume, low cost manufacturing.

Other objects of the present invention include: the provision of an antenna exhibiting high gain and a front-to-back ratio which is substantially greater than known antenna devices; the provision of an antenna suitable for integration within or upon a WCD; the provision of an antenna having wide bandwidth in one or more frequency bands; the provision of an antenna which radiates RF energy from a WCD preferentially away from a user thereof; and the provision of an antenna promoting increased WCD battery life by reducing commanded RF power.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE DRAWINGS

The 1800-1900/UMTS band antenna system in accordance with one embodiment of the present invention is capable of improved efficiency as compared to prior art antennas, particularly in the range of 3 to 10 dB. The improvement in electrical efficiency derives at least in part from the installation location of the PIFA resonator.

Embodiments of the present invention present a substantial improvement over the prior art with respect to PIFA top leg height above the ground plane vs. antenna gain, bandwidth, and beamwidth in the hemisphere away from the user's head and body. Embodiments of a PIFA antenna system of the present invention operate with excellent performance at a height of 8.5 mm nominal, which is considerably shorter than prior art top leg height. This reduction in top leg height provides for compatibility with the current smaller WCD sizes.

Embodiments of the present invention realize a free space gain over the 1710-2170 MHz range as +3.5 dBi minimum and +4.5 dBi typical. In one example, the front-to-back ratio is 25 dB peak, which nearly eliminates power lost into the user's head. The oriented PIFA design of the present invention also greatly reduces power loss to the user's hand. The power that is typically lost to the user's head in prior art antennas is added to that radiated out into the hemisphere away from the head by the antenna embodiments of the present invention. The useable beamwidth in that hemisphere is in excess of 180 degrees, which vastly increases the likelihood of the handset reliably connecting to a nearby or distant base station, when compared to prior art antennas.

The PIFA resonator of the present invention may be manufactured in high volume by conventional methods such as metal stamping, selective plating of dielectrics, or a combination of metal stampings attached to a dielectric base.

Figure 1:
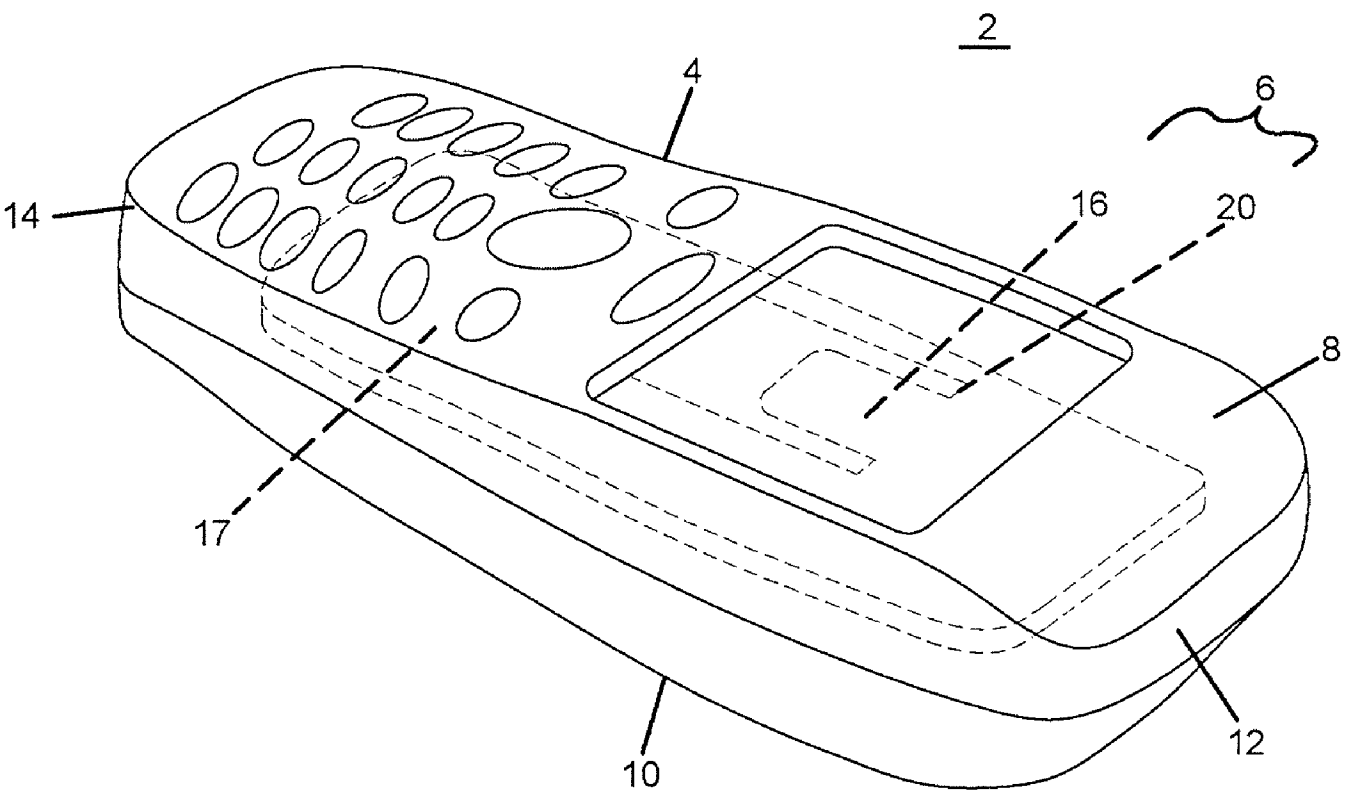
FIG. 1 is a perspective view of a wireless communications device utilizing an antenna system of the present invention.

Referring to FIG. 1, a device according to one embodiment of the present invention is indicated as numeral 2. Device 2 includes a portable wireless device "PWD" 4 and an antenna structure 6. Relative to a device user, in operation PWD 4 includes a front side 8 which is nearer to the user than a back side 10. PWD 4 has a top 12 and a bottom 14. In operation, bottom 14 is between top 12 and the ground surface upon which the user is positioned. PWD 4 is generally aligned in operation so that its top 12 is above a user's hand which grasps the PWD. PWD 4 includes a ground plane 16, typically a conductive plane within a printed wiring board upon which electronic components 17 are secured. Antenna structure 6 includes a ground plane element 16 and a configured radiating conductor (resonator) element 20. Resonator 20 may include a plurality of planar surfaces or may be configured to have some curvature or other shape. Resonator 20 may be formed as a metal part or may be a plating or conductive layer disposed upon a support element. As would be appreciated by one of ordinary skill in the art, signal generating components 17 include a variety of digital and/or analog components functioning to transmit, receive and process rf signals to and from PIFA element 20.

FIGS. 2-15 depict devices having an antenna system in accordance with the present invention. With reference to FIGS. 2-6, resonator 20 includes an upwardly directed conductor (top portion) 22 having a free end 24 defined by a pair of conductor legs 26 separated by an open section 28, a pair of leg conductors 30, and a feed leg conductor 32. Leg conductors 30 are connected to ground plane 16 as indicated by numeral 34 in FIG. 6. A feedpoint 40, having a desired impedance, is defined upon leg conductor 32. Resonator portions 22, 26, 30 and 32 may be provided with differing widths and/or thicknesses. A coaxline or a microstrip or other type of transmission line may be used to couple the feedpoint to signal electronics of PWD 4. In intended operation, free end 24 is located above leg elements 30, 32 relative to the ground surface upon which the device user is positioned. Portion 22 of resonator 20 is spaced away from ground plane 16 a distance "H1". The overall length of resonator 20 (D1+D2) can be adjusted for resonance over the desired frequency range.

Figure 2:
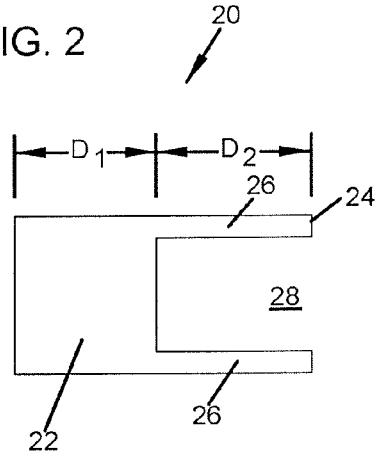
FIG. 2 is a top plan view of a resonator portion of an antenna system of a first embodiment of the present invention.
Figure 3:
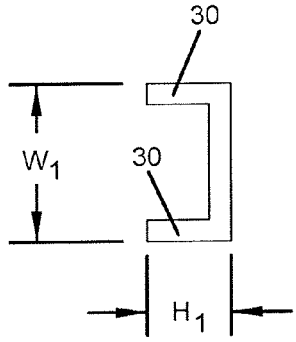
FIG. 3 is a side elevational view of the antenna system portion of FIG. 2.
Figure 4:
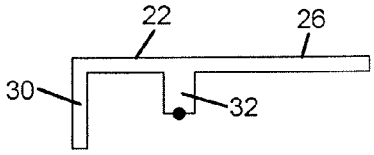
FIG. 4 is a side elevational view of the antenna system portion of FIG. 2.

FIGS. 2-4 illustrate top, end and side views of PIFA resonator 20 in accordance with the present invention. The resonator 20 is suitable for an antenna system for operation over the frequency range of 1710-2170 MHz. Top leg conductors 26 may have a width in the range of 0.03-0.2 inch, with a preferred width of 0.1 inch. Width, W1, may be in the range of 0.3-1 inch, with a preferred value of 0.62 inch. Height, H1, may be in the range of 0.2-0.8 inch, with a preferred value of 0.3 inch. Legs 30 may have a width in the range of 0.03-0.31 inch. As shown, the top portion of resonator 20 is bifurcated and substantially symmetric.

Figure 5:
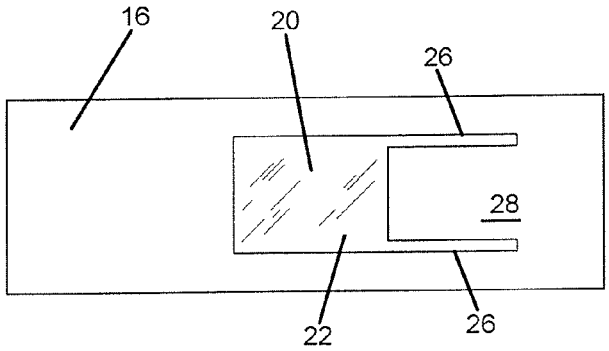
FIG. 5 is a top plan view of an antenna system of a first embodiment of the present invention.
Figure 6:
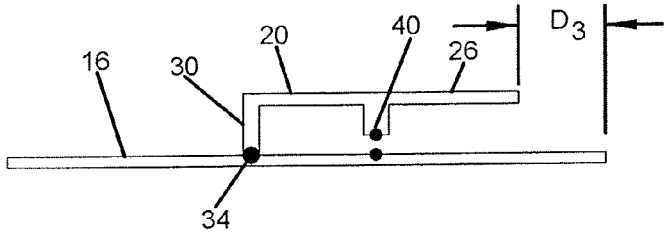
FIG. 6 is a side elevational view of the antenna system of FIG. 5.

FIGS. 5 and 6 depict resonator 20 which is PIFA-fed at location 40, with one end connected to the ground plane conductor 16 at location 34. Ground plane conductor 16 may be defined as a conductive ground layer(s) or ground trace on a printed circuit board (PCB). Location 34 is considerable removed from the end of ground plane conductor 16. This provides a much more compact antenna which is less susceptible to breakage during use on a WCD handset.

Overall length, D1+D2, is in the range of 1.2-1.8 inches, with a preferred length of 1.5 inches. Open section 28 is defined between the pair of legs 26. The overall length of portion 22 is in the range of 0.2-1.2 inches, with a preferred value of 0.83 inch. It is believed that open section 28 permits a substantial reduction in height, H1, while maintaining desired antenna performance characteristics. This reduction in height permits PIFA resonator 20 to be installed in a wider range of compact wireless communications devices relative to prior art antenna systems. Distance, D3, may be in the range of 0.5-1.5 inches, with a preferred value of 1.0 inch.

Figure 7:
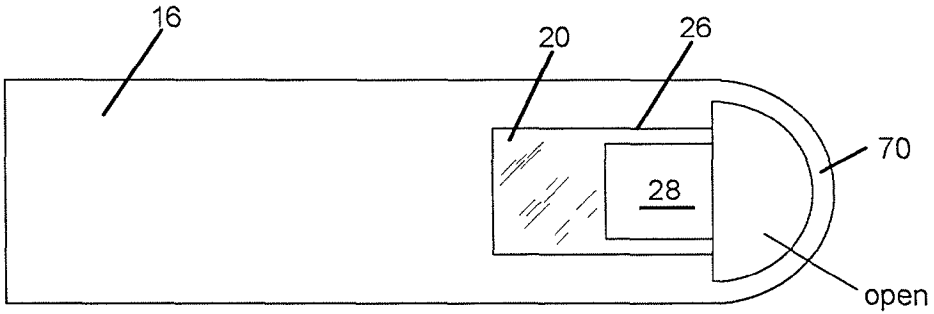
FIG. 7 is a top plan view of portions of an antenna system of a second embodiment of the present invention.
Figure 8:
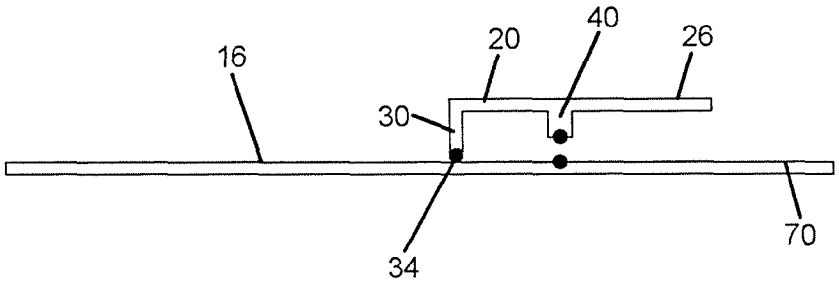
FIG. 8 is a side elevational view of the antenna system of FIG. 7.

Referring to FIGS. 7 and 8, another embodiment 31 of an antenna system in accordance with the present invention is shown using plan and side views. PIFA resonator 20 is shown electrically connected to ground plane 16 at location 34. The ground plane 16 has a loop extension 70, which has a preferred length of 1.0 inch. A low impedance RF feed point is provided generally across leg 40 and ground plane 16. Additional disclosure of ground plane conductors having loop extension can be found in U.S. patent application Ser. No. 12/199,474, incorporated by reference herein for all purposes.

Figure 9:
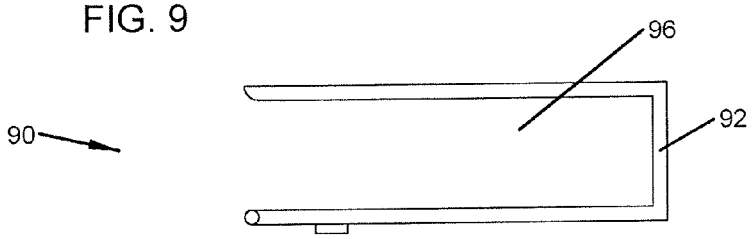
FIG. 9 is a top plan view of portions of an antenna system of a third embodiment of the present invention.
Figure 10:
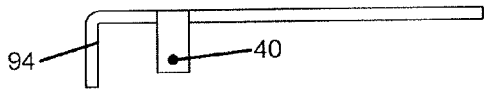
FIG. 10 is a side elevational view of the antenna system of FIG. 9

FIGS. 9 and 10 depict another embodiment 90 of a PIFA resonator in accordance with the present invention. Conductors 92, 94 may be wire or have other cross sectional shapes. Section 96 is open.

Figure 11:
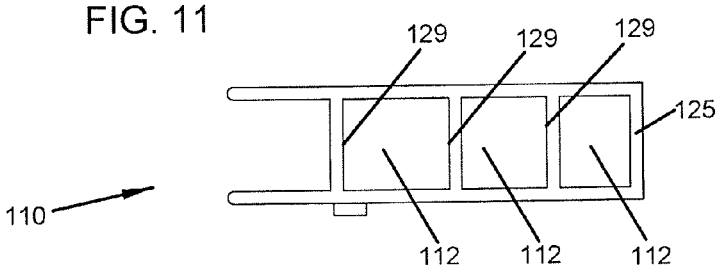
FIG. 11 is a top plan view of portions of an antenna system of a fourth embodiment of the present invention.
Figure 12:
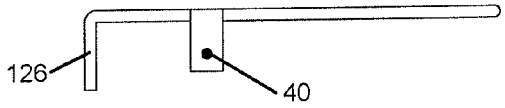
FIG. 12 is a side elevational view of the antenna system of FIG. 11.

FIGS. 11 and 12 depict another embodiment 110 of a PIFA resonator in accordance with the present invention. Open areas 112 and bridge conductor segments 125, 129 and leg 126 form the PIFA resonator 110. The conducting segments may be wire or have other cross sectional shapes.

Figure 13A:
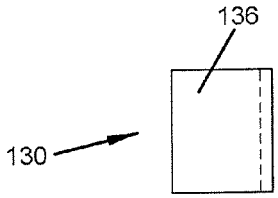
FIG. 13 is a top plan view of portions of an antenna system of a fifth embodiment of the present invention.
Figure 13B:
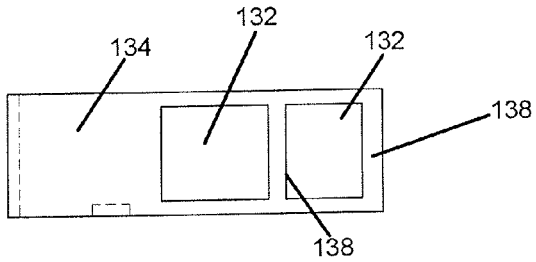
Figure 14:
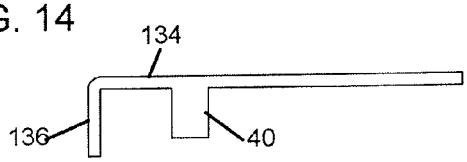
FIG. 14 is a side elevational view of the antenna system of FIG. 13.
Figure 15:
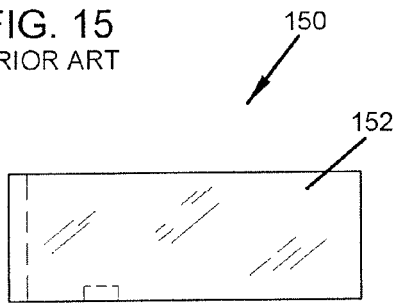
FIG. 15 PRIOR ART
FIGS. 15-19 illustrate various prior art antenna systems.
Figure 16:
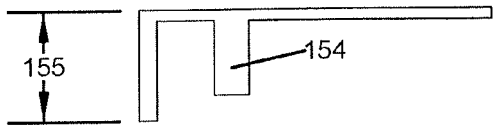
Figure 17:
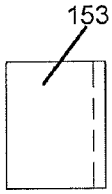
Figure 18:
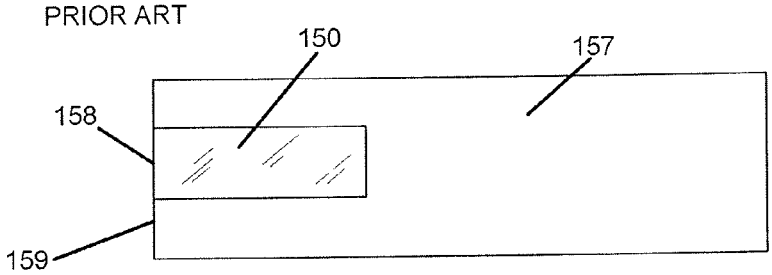
FIG. 18 PRIOR ART
Figure 19:
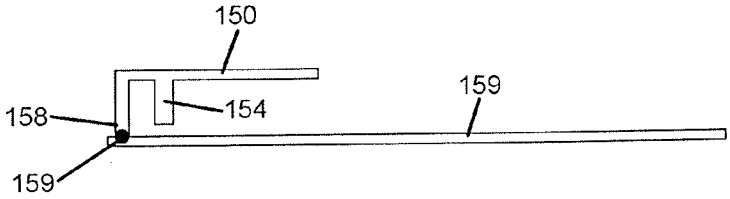

FIGS. 13 and 14 illustrate yet another embodiment 130 of a PIFA resonator of the present invention. Sections 132 are open, and sections 134, 136 are sheet conductors. Legs 138 may be wire or have other cross sectional shapes.

For each illustrated embodiments, the open sections may be defined by perforations or apertured metal sections. In other embodiments, a screen or other conductive element may be positioned within open section 28, 96, 112, 132.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. An antenna system for a wireless communications device comprising:

a ground plane conductor defined at least by portions of a printed wiring board of the wireless communications device, said ground plane conductor defining a pair of longitudinal ends including an upper end having an open section positioned at an upper end of the wireless communications device during intended communications therefrom; and a PIFA-fed resonator having a ground end and a free end, with said ground end being electrically coupled to the ground plane conductor at a ground point located a distance away from said upper end of said pair of longitudinal ends, and with the resonator defining a feed point within the region between the ground point and said one longitudinal end, wherein at least a portion of the resonator between the feed point and the free end overlays the ground plane conductor and another portion of the resonator defines an open section relative to the ground plane conductor and said open section of the resonator is adjacent the open section of the ground plane conductor.

2. The antenna system of claim 1 wherein a pair of leg portions define the ground end of the resonator.

3. The antenna system of claim 1 wherein the open section of the resonator is defined between a pair of generally parallel conductors of a top portion of the resonator.

4. The antenna system of claim 1 wherein the open section of the resonator includes a plurality of open segments with one or more bridge portions extending between sides of the resonator.

5. The antenna system of claim 4 wherein the resonator includes a sheet conductor at said ground end and a sheet conductor at a top portion of said resonator.

6. The antenna system of claim 1 wherein the free end of the resonator is positioned between one of said pair of longitudinal ends of the ground plane conductor and the feed point.

7. An antenna system for a wireless communications device comprising:

a ground plane conductor defined at least by portions of a printed wiring board of the wireless communications device, said ground plane conductor defining a pair of longitudinal ends with an open section of the ground plane conductor being positioned at an upper one of the pair of longitudinal ends; and a PIFA-formed resonator having a ground end and a free end, with said ground end being electrically coupled to the ground plane conductor at a ground point located a distance away from one of the pair of longitudinal ends, and with the conductor defining a feed point within the region between the ground point and said one longitudinal end, wherein said resonator includes a top portion having a sheet conductor and an open section proximate to said free end, said open section of the resonator being adjacent the open section of the ground plane conductor.

8. The antenna system of claim 7 wherein a pair of leg portions define the ground end of the resonator.

9. The antenna system of claim 7 wherein the open section of the resonator is defined between a pair of generally parallel conductors of a top portion of the resonator.

10. The antenna system of claim 7 wherein the open section of the resonator includes a plurality of open segments with one or more bridge portions extending between sides of the resonator.

11. The antenna system of claim 10 wherein said resonator includes a sheet conductor at said ground end and a sheet conductor at a top portion of said resonator.

12. The antenna system of claim 7 wherein the free end of the resonator is positioned between one of said pair of ends of the ground plane conductor and the feed point.

13. The antenna system of claim 7 wherein the free end of the resonator is located between the open section and the feed point.

14. An antenna system for a wireless communications device comprising:

a ground plane conductor defined at least by portions of a printed wiring board of the wireless communications device, said ground plane conductor defining a pair of longitudinal ends and a pair of lateral sides, and said ground plane conductor having an open ground plane extension portion proximate to one of said pair of longitudinal ends; and a PIFA-formed resonator having a ground end and a free end, with said ground end being electrically coupled to the ground plane conductor at a ground point located a distance away from one of the pair of longitudinal ends, and with the conductor defining a feed point within the region between the ground point and said one longitudinal end, wherein a top leg of the resonator includes an open section at the free end positioned adjacent to said open ground plane extension portion.

15. The antenna system of claim 14 wherein a pair of leg portions define the ground end of the resonator.

16. The antenna system of claim 14 wherein the open section is defined between a pair of generally parallel conductors of a top portion of the resonator.

17. The antenna system of claim 14 wherein the open section includes a plurality of open segments with one or more bridge portions extending between sides of the resonator.

18. The antenna system of claim 17 wherein the resonator includes a sheet conductor at said ground end.

19. The antenna system of claim 18 wherein a resonator top is defined as a sheet conductor, with said sheet conductor being between said ground end and a plurality of open sections.

* * * * *